US005813841A

United States Patent [19]

Sturman

[11] Patent Number: 5,813,841

[45] Date of Patent: Sep. 29, 1998

[54] HYDRAULIC PRESSURE CONTROL SYSTEM FOR A PUMP

[75] Inventor: Oded E. Sturman, Woodland Park, Colo.

[73] Assignee: Sturman Industries, Woodland Park, Colo.

[21] Appl. No.: 648,681

[22] Filed: May 16, 1996

[51] Int. Cl.[6] ..... F04B 7/00

[52] U.S. Cl. ..... 417/446; 417/298; 137/625.65

[58] Field of Search ..... 417/298, 446; 137/625.65

[56] References Cited

U.S. PATENT DOCUMENTS

| | | | |
|---|---|---|---|
| 2,134,693 | 11/1938 | Bartholomew | 417/298 X |
| 2,329,931 | 9/1943 | Neeson | 417/298 X |
| 3,225,785 | 12/1965 | Goike . | |
| 4,317,469 | 3/1982 | Pauliukonis | 137/625.65 |
| 4,389,167 | 6/1983 | Farr . | |
| 4,526,145 | 7/1985 | Honma et al. . | |
| 4,730,987 | 3/1988 | Kawai et al. | 417/298 X |
| 5,456,581 | 10/1995 | Jokela et al. . | |
| 5,577,892 | 11/1996 | Schittler et al. . | |
| 5,636,973 | 6/1997 | Sonobe et al. | 417/298 X |

FOREIGN PATENT DOCUMENTS

| | | | |
|---|---|---|---|
| 174143 | 8/1952 | Austria | 417/298 |
| 0 375 944 A | 7/1990 | European Pat. Off. . | |
| 40 29 510 A | 3/1991 | Germany . | |
| 41 18 236 A | 12/1991 | Germany . | |
| 44 01 073 A | 7/1995 | Germany . | |
| WO 96 17167 A | 6/1996 | WIPO . | |

OTHER PUBLICATIONS

Patent Abstracts of Japan; vol. 096, No. 010, 31 Oct. 1996 & JP 08 158971 A (Zexel Corp), 18 Jun. 1996.

*Primary Examiner*—Timothy Thorpe
*Assistant Examiner*—Cheryl J. Tyler
*Attorney, Agent, or Firm*—Blakely Sokoloff Taylor & Zafman

[57] ABSTRACT

A positive displacement pump assembly which has an hydraulically controlled intake check valve that is controlled by a three-way solenoid control valve. The intake valve contains a one-way check valve that opens when the pump piston is on an intake stroke and normally closes when the pump piston is on a power stroke. The check valve further contains an hydraulically controlled piston that can open the check valve during the power stroke so that the output fluid of the pump flows to drain. The piston is controlled by the solenoid control valve. The control valve has a pair of digitally latched solenoids. The output pressure of the pump can be regulated by energizing one of the solenoids and applying hydraulic pressure to the piston to open the check valve during the power stroke of the pump. The pump is preferably a dual piston wobble plate pump that incorporates a pair of hydraulically controlled intake check valves that are both controlled by a single solenoid control valve.

6 Claims, 2 Drawing Sheets

HYDRAULIC PRESSURE CONTROL SYSTEM FOR A PUMP

BACKGROUND OF THE INVENTION

1. Field of the Invention

The present invention relates to a pump.

2. Description of Related Art

The fuel injector system of an internal combustion engine can be pressurized by a positive displacement pump. To prevent overpressurization of the system the pump may have a by-pass valve that directs the output of the pump to drain when the system pressure reaches a predetermined level. The by-pass valve provides a means to control the maximum pressure of the system. Conventional by-pass valves typically contain a spring biased relief valve that opens when the fluid pressure overcomes the force of the spring. The pump is therefore continuously working against the spring of the by-pass valve. The additional work required to overcome the spring of the by-pass valve lowers the energy efficiency of the pump.

The output pressure of a positive displacement pump can also be changed by varying the speed of the drive motor. The response time of varying the drive motor speed is relatively slow because of the inertia of the pump and the motor. It would therefore be desirable to provide a positive displacement pump that has an efficient by-pass function and which can accurately control the output pressure of the pump.

SUMMARY OF THE INVENTION

The present invention is a positive displacement pump assembly which has an hydraulically controlled intake check valve that is controlled by a three-way solenoid control valve. The intake valve contains a one-way check valve that opens when the pump piston is on an intake stroke and normally closes when the pump piston is on a power stroke. The check valve further contains an hydraulically controlled piston that can open the check valve during the power stroke so that the output fluid of the pump flows to drain. The piston is controlled by the solenoid control valve. The control valve has a pair of digitally latched solenoids. The output pressure of the pump can be regulated by energizing one of the solenoids and applying hydraulic pressure to the piston to open the check valve during the power stroke of the pump. The pump is preferably a dual piston wobble plate pump that incorporates a pair of hydraulically controlled intake check valves that are both controlled by a single solenoid control valve.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
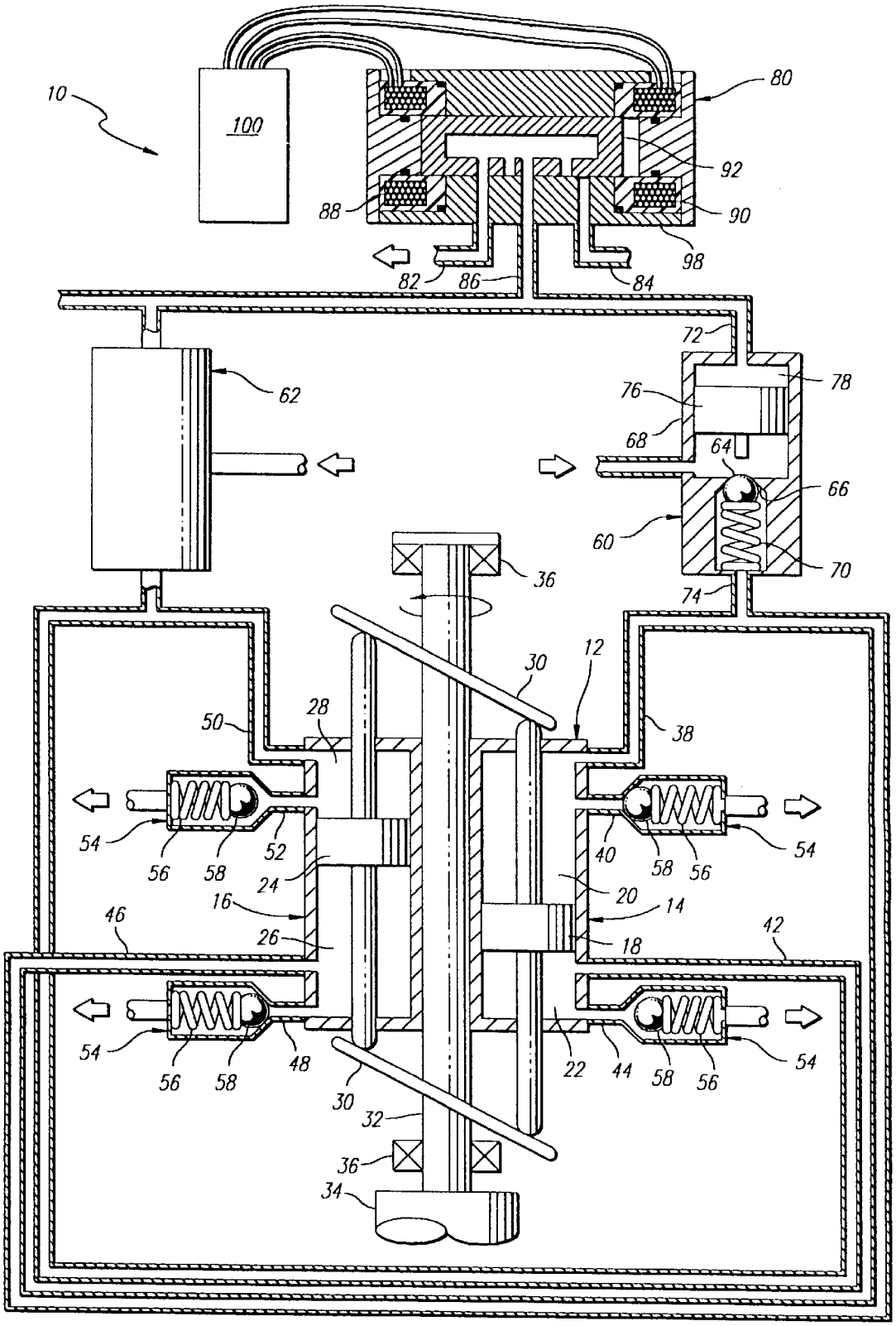
FIG. 1 is a schematic of a pump assembly of the present invention.

Referring to the drawings more particularly by reference numbers, FIG. 1 shows a pump 10 of the present invention. The pump 10 may be used in a fluid system such as a fuel injection system of an internal combustion engine. In the preferred embodiment, the pump 10 is a positive displacement wobble plate device. Although a wobble plate pump is described and shown, it is to be understood that the present invention may be employed with other types of pumps.

The pump 10 has a housing 12 that contains a first chamber 14 and a second chamber 16. Located within the first chamber 14 is a first piston 18 that separates a first pump chamber 20 from a second pump chamber 22. Within the second chamber 16 is a second piston 24 that separates a third pump chamber 26 from a fourth pump chamber 28. The pistons 18 and 24 are reciprocated by a pair of wobble plates 30 that are attached to a rotating drive shaft 32. The drive shaft 32 typically extends from an electric motor 34 and is aligned by bearing assemblies 36.

The pump 10 has a first inlet port 38 and a first outlet port 40 coupled to the first pump chamber 20, a second inlet port 42 and a second outlet port 44 coupled to the second pump chamber 22, a third inlet port 46 and a third outlet port 48 coupled to a third pump chamber 24, and a fourth inlet port 50 and a fourth outlet port 52 coupled to the fourth pump chamber 28. The drive shaft 32 and wobble plates 30 reciprocate the pistons 18 and 24 between intake and exhaust strokes in an alternating pattern, wherein the first 20 and third 26 pump chambers are drawing in fluid when the second 22 and fourth 28 pump chambers are pumping out fluid, and vice versa. The pump chambers receive fluid from the inlet ports and pump out fluid through the outlet ports. Each outlet port has an outlet check valve 54 which contains a spring 56 that biases a ball-valve 58 to prevent a reverse flow of fluid into the pump chamber.

The first 38 and third 46 inlet ports are coupled to a first hydraulic check valve 60. The second 42 and fourth 50 inlet ports are coupled to a second hydraulic check valve 62. The check valves 60 and 62 control the flow of fluid into and out of the pump chambers. Each control valve contains a ball-valve 64 that is biased into a valve seat 66 of a housing 68 by a spring 70. The housing 70 has an inlet port 72 and an outlet port 74 that are in fluid communication with a source of fluid and a pump chamber, respectively.

The pistons 18 and 24 reciprocate through motions which expand and contract the pump chambers. Expanding the pump chambers decrease the pressure within the chambers. The differential pressure across each ball-valve 64 overcomes the force of the spring 70 and opens the check valve to allow fluid to flow into the chamber. When the volume of a pump chamber decreases the corresponding pressure increases and pushes the ball-valve closed, so that fluid only flows through the outlet valve.

Each check valve has a piston 76 that can move the ball-valve 64 to the open position. The piston 76 is driven by a working fluid in chamber 78. The pressure of the working fluid within the chamber 78 is controlled by a solenoid control valve 80. The solenoid control valve 80 is preferably a three-way valve with a first port 82 coupled to a high pressure source of fluid, a second port 84 coupled to a low pressure source of fluid and a third port 86 coupled to the chambers 78 of the check valves.

The control valve 80 has a first solenoid 88 and a second solenoid 90 that are coupled to a spool 92. Energizing a solenoid will pull the spool to one end of the valve. The solenoids and spool are located within a housing 98. The spool and housing are preferably constructed from a magnetic material such as a 52100 or 440 c harden steel, so that the residual magnetism of the material will hold the spool in one of two positions even after the solenoids are de-energized.

The solenoids are coupled to a controller 100 which provides a plurality of digital pulses to the solenoids to move the spool. Energizing the first solenoid moves the spool to a first position to couple the second port to the first port. The first solenoid is energized for a short duration to pull the spool to the end of the housing. After the short duration pulse, power is terminated, wherein the residual magnetism of the material maintains the position of the spool. The second solenoid can then be energized by a digital pulse from the controller 100 to move the spool to a second position, wherein the first port is coupled to the third port and high pressure working fluid is introduced to the chambers 78 of the check valves.

As shown in FIG. 1, in operation, the wobble plates move the pistons to increase the first 20 and third 26 pump chambers, which draw fluid in through check valve 60. The second 22 and fourth 28 pump chambers pump fluid through the outlet ports. The check valve 62 remains closed to that the full volume of fluid within the second 22 and fourth 28 pump chambers is pumped into the outlet ports. Continued rotation of the wobble plates causes the pistons to pump fluid out of the first 20 and third 26 pump chambers and draw fluid into the second 22 and fourth 28 pump chambers.

Figure 2:
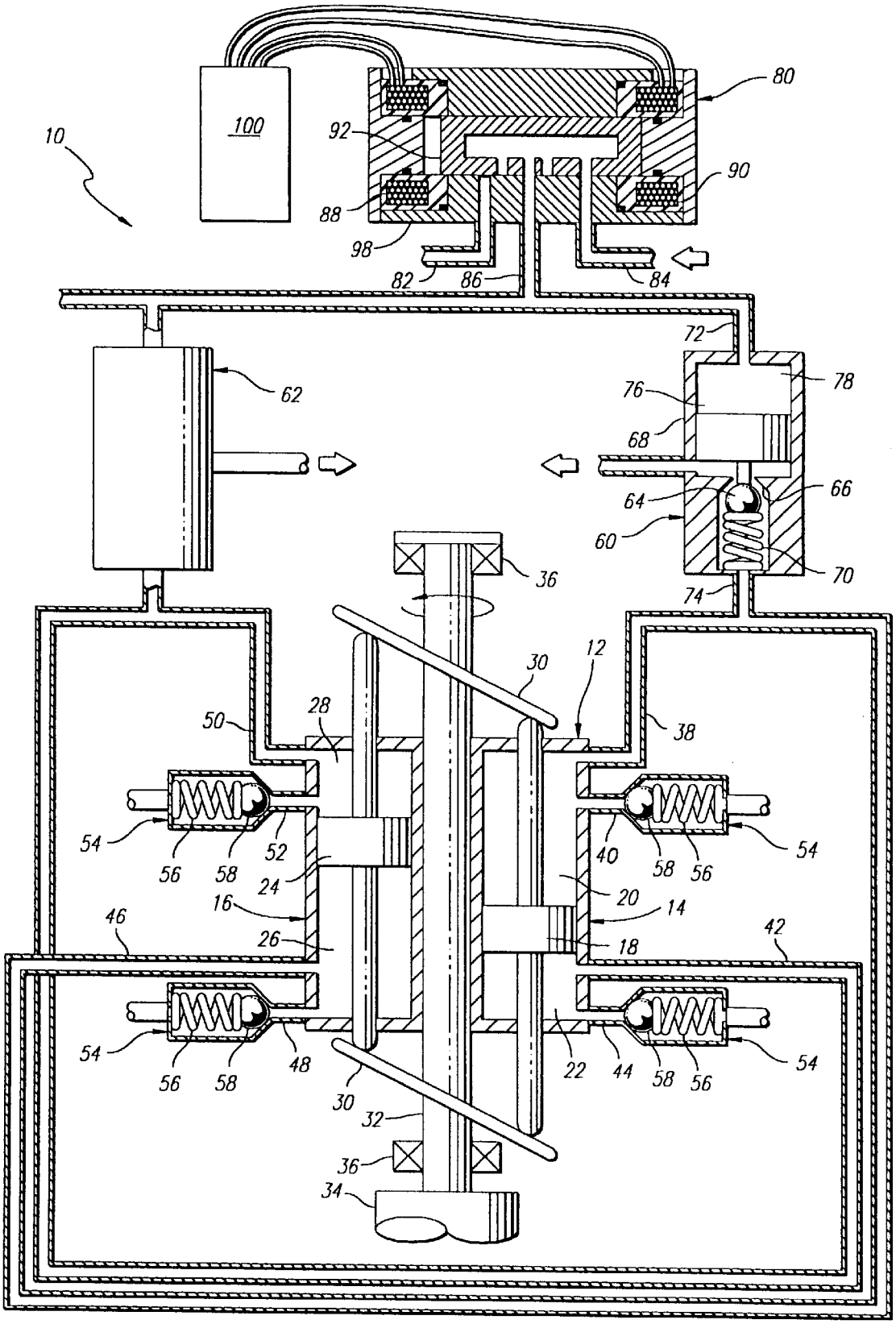
FIG. 2 is a schematic of the pump during a power stroke with the intake check valve open.

As shown in FIG. 2, the output pressure of the pump can be controlled by energizing the second solenoid 90 of the control valves 80 so that working fluid flows into the check valve chambers 78 and cause the pistons 76 to open the ball-valves 64. The opened check valves allow the output fluid of the pump chambers to flow back through the inlet ports into the low pressure line of the system. The pistons may maintain the intake check valves in the open position until the system pressure has reached a desired pressure. To this end the controller 100 can be coupled to a pressure sensor which senses the fluid pressure of the system and provides feedback signals to the controller. The controller can regulate the output of the pump in response to the feedback signals. The hydraulically controlled intake valve provide a fluid by-pass without requiring the pump to expend additional energy during the by-pass cycle of the pump.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A pump, comprising:

a pump housing with a first chamber and a second chamber;

a first piston that separates said first chamber into a first pump chamber and a second pump chamber;

a second piston that separates said second chamber into a third pump chamber and a fourth pump chamber;

a pair of wobble plates that move said first and second pistons in a reciprocating motion;

a first inlet port coupled to said first pump chamber, a second inlet port coupled to said second pump chamber, a third inlet port coupled to said third pump chamber and fourth inlet port coupled to said fourth pump chamber;

a first hydraulically controlled inlet check valve that controls the flow of a pump fluid through said first and third inlet ports;

a second hydraulically controlled inlet check valve that controls the flow of the pump fluid through said second and fourth inlet ports; and, a solenoid control valve that controls said first and second hydraulically controlled inlet check valves to regulate a reverse flow of pumping fluid through said inlet ports to control an output pressure of the pump.

2. The pump as recited in claim 1, wherein said solenoid control valve is a three-way valve.

3. The pump as recited in claim 1, wherein said solenoid control valve contains a spool that cooperates with a first solenoid and a second solenoid to control the flow of a working fluid to actuate said first and second hydraulically controlled inlet check valves, wherein said spool moves to a first position when said first solenoid is energized to prevent working fluid from actuating said first and second hydraulically controlled inlet check valves, and said spool moves to a second position when said second solenoid is energized to allow working fluid to actuate said first and second hydraulically controlled inlet check valves and allow pumping fluid to flow out of said pump chamber through said inlet port.

4. The pump as recited in claim 3, wherein said first and second solenoids are energized by a plurality of digital pulses.

5. The pump as recited in claim 3, wherein said hydraulically controlled inlet check valves each contain a check valve that is opened by a piston when the working fluid flows into said hydraulically controlled inlet check valves.

6. The pump as recited in claim 5, further comprising a plurality of check valves coupled to a plurality of outlet ports in fluid communication with said pump chambers.

* * * * *